US005813083A

United States Patent [19]

Gould

[11] Patent Number: 5,813,083

[45] Date of Patent: Sep. 29, 1998

[54] EASY SCRATCH PEN TOOL

[76] Inventor: Clarence F. Gould, 49 Gerald Avenue, Truro, Nova Scotia, Canada, B2N 5N6

[21] Appl. No.: 990,230

[22] Filed: Dec. 15, 1997

[51] Int. Cl.[6] ..... A47L 13/02

[52] U.S. Cl. ..... 15/236.01; 30/162; 30/169; 30/335

[58] Field of Search ..... 15/236.01; 30/162, 30/169, 329, 335

[56] References Cited

U.S. PATENT DOCUMENTS

| | | | |
|---|---|---|---|
| 509,867 | 12/1893 | Brady | 15/236.01 |
| 2,147,561 | 2/1939 | Sherlock | 30/169 |
| 3,436,823 | 4/1969 | Lamb | 30/335 |
| 4,660,287 | 4/1987 | Decker | 30/335 |
| 5,175,934 | 1/1993 | Chao | 30/329 |
| 5,620,453 | 4/1997 | Nallakrishnan | 30/335 |

FOREIGN PATENT DOCUMENTS

| | | | |
|---|---|---|---|
| 2007682 | 10/1970 | Germany | 30/335 |

*Primary Examiner*—Randall E. Chin

[57] ABSTRACT

An easy scratch pen tool including an elongated housing member that has an interior hollow. The interior hollow extends the length of the housing member. The housing member has a slot for providing an entry into the hollow. Also, a cap member is mounted to the housing member. The cap has a cap hollow for positioning of a button rod with a coiled spring within. The button rod has a button tip projecting outwardly form the cap member. Lastly, an elongated scratcher member is provided. The scratcher member has a flat end and a scratcher tip. The flat end of the scratcher is in communication with the button rod of the cap.

6 Claims, 1 Drawing Sheet

EASY SCRATCH PEN TOOL

BACKGROUND OF THE INVENTION

1. Field of the Invention

The present invention relates to a easy scratch pen tool and more particularly pertains to providing a tool for use in the removal of the film covering the winning expression of a game ticket.

2. Description of the Prior Art

The use of a scrapper tool is known in the prior art. More specifically, Scrapper tools heretofore devised and utilized for the purpose of paint and film removal are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,881,291 to Ellis discloses a lottery ticket scraper enabling precise removal of surface layer from ticket. U.S. Pat. No. 5,423,843 to Werner discloses a retractable surgical knife. U.S. Pat. No. Des. 338,755 to Belchik discloses a lottery ticket scrapper. U.S. Pat. No. 302,174 to Coburn discloses a combined pen and knife. U.S. Pat. No. 4,654,923 to Faciane et al. discloses a lottery ticket processor. Lastly, U.S. Pat. No. 4,240,202 to Gilbert discloses a replaceable blade knife.

In this respect, the easy scratch pen tool according to the present invention substantially departs from the conventional concepts and designs of the prior art, and in so doing provides an apparatus primarily developed for the purpose of providing a tool for use in the removal of the film covering the winning expression of a game ticket.

Therefore, it can be appreciated that there exists a continuing need for a new and improved easy scratch pen tool which can be used for providing a tool for use in the removal of the film covering the winning expression of a game ticket. In this regard, the present invention substantially fulfills this need.

SUMMARY OF THE INVENTION

In view of the foregoing disadvantages inherent in the known types of scrapper tools now present in the prior art, the present invention provides an improved Easy scratch pen tool. As such, the general purpose of the present invention, which will be described subsequently in greater detail, is to provide a new and improved easy scratch pen tool which has all the advantages of the prior art and none of the disadvantages.

To attain this, the present invention essentially comprises an elongated housing member. The housing member has a first end and a second end. The housing member has an interior hollow extending from the first end of the housing to the second of the housing. The housing member has an exterior surface. The first end of the housing member has a generally rectangular slot for providing an entry into the hollow.

Included is a cap member. The cap member is mounted to the second end of the housing member. The cap has a cap hollow for positioning of a button rod with a coiled spring. The button rod has a button tip projecting outwardly form the cap member.

Also, a clip is mounted between the cap and the housing member. The clip is formed of a resilient material and has a clip arm extended along a portion of the exterior surface of the housing member. The clip arm has a free end with a protrusion adjacent the exterior surface of the housing member.

Lastly, an elongated scratcher member is provided. The scratcher member is generally rectangular and has a flat end and a scratcher tip. The scratcher member is sized for passing through the rectangular slot of the housing member and positioning within the interior hollow of the housing member. The flat end of the scratcher member is in communication with the button rod of the cap. The scratcher tip is enclosed within the housing member and capable of projecting outwardly therefrom when pressure is applied to the button tip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved easy scratch pen tool which has all the advantages of the prior art scrapper tools and none of the disadvantages.

It is another object of the present invention to provide a new and improved easy scratch pen tool which may be easily and efficiently manufactured and marketed.

It is a further object of the present invention to provide a new and improved easy scratch pen tool which is of a durable and reliable construction.

An even further object of the present invention is to provide a new and improved easy scratch pen tool which is susceptible of a low cost of manufacture with regard to both materials and labor, and which accordingly is then susceptible of low prices of sale to the consuming public, thereby making such Easy scratch pen tool economically available to the buying public.

Still yet another object of the present invention is to provide a new and improved easy scratch pen tool which provides in the apparatuses and methods of the prior art some of the advantages thereof, while simultaneously overcoming some of the disadvantages normally associated therewith.

Still another object of the present invention is to providing a tool for use in the removal of the film covering the winning expression of a game ticket.

Lastly, it is an object of the present invention to provide a new and improved elongated housing member that has an interior hollow. The interior hollow extends the length of the housing member. The housing member has a slot for providing an entry into the hollow. Also, a cap member is mounted to the housing member. The cap has a cap hollow for positioning of a button rod with a coiled spring within. The button rod has a button tip projecting outwardly form the cap member. Lastly, an elongated scratcher member is provided. The scratcher member has a flat end and a scratcher tip. The flat end of the scratcher is in communication with the button rod of the cap.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figures 1, 2, 3, 4:
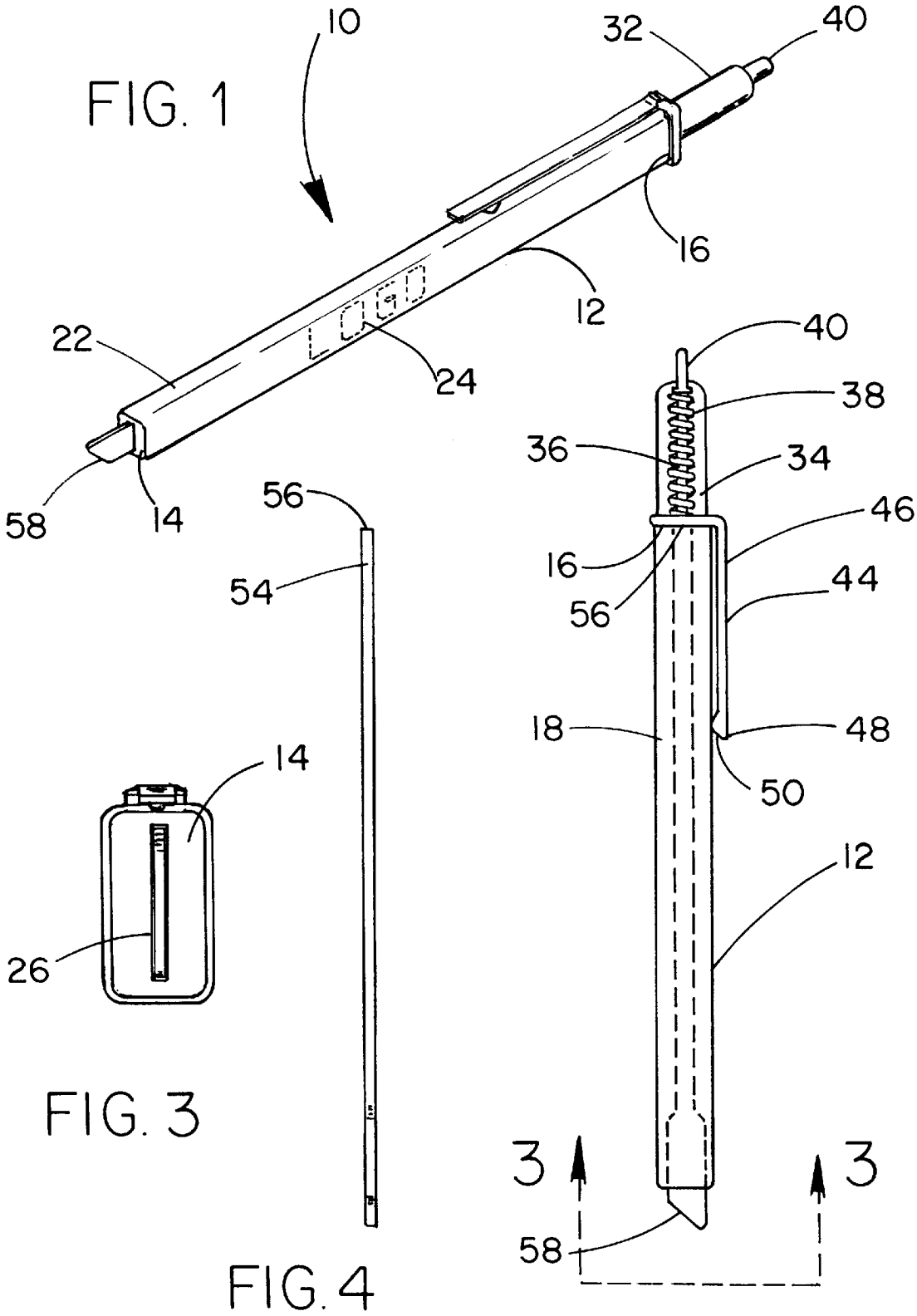
FIG. 1 is a perspective illustration of the preferred embodiment of the easy scratch pen tool constructed in accordance with the principles of the present invention.
FIG. 2 is a side view of the present invention of FIG. 1.
FIG. 3 is an end view of the present invention taken along line 3—3 of FIG. 2.
FIG. 4 is an end edge view of the scratcher of the present invention.

With reference now to the drawings, and in particular to FIG. 1 thereof, a new and improved easy scratch pen tool embodying the principles and concepts of the present invention and generally designated by the reference numeral 10 will be described.

The present invention, the new and improved easy scratch pen tool, is comprised of a plurality of components. Such components in their broadest context include a housing and a scratcher member. Such components are individually configured and correlated with respect to each other so as to attain the desired objective.

More specifically, the present invention includes an elongated housing member 12 formed of a rigid plastic. The housing member has a first end 14 and a second end 16. The housing member has an interior hollow 18 extending from the first end of the housing to the second end of the housing, as shown in FIG. 2. The housing member has an exterior surface 22 that can be painted or etched with indicia 24. The first end of the housing member has a generally rectangular slot 26. The slot, as shown in FIG. 3, provides an entry into the interior hollow.

Included is a cap member 32, as shown in FIG. 1. The cap member is mounted to the second end 16 of the housing member. The cap has a cap hollow 34. The cap hollow allows the positioning of a button rod 36 with a coiled spring 38. The button rod has a button tip 40 projecting outwardly form the cap member, as depicted in FIGS. 1 and 2.

Also, a clip 44 is mounted between the cap and the housing member 12. The clip is formed of a resilient material and has a clip arm 46 extended along a portion of the exterior surface 22 of the housing member. The clip arm has a free end with a protrusion 50. The protrusion is adjacent the exterior surface of the housing member and allows the clip to hold the housing member in place when it is clipped to a shirt or trouser pocket.

Lastly, an elongated scratcher member 54 is provided. The scratcher member is generally rectangular, as shown in FIG. 4. The scratcher member has a flat end 56 and a scratcher tip 58. The scratcher member is sized for passing through the rectangular slot of the housing member for positioning within the interior hollow of the housing member. The flat end of the scratcher member is in communication with the button rod 36 of the cap. The scratcher tip is enclosed within the housing member. The scratcher tip is capable of projecting outwardly from the first end when pressure is applied to the button tip.

The present invention easy scratch pen tool is a device that allows the user to scratch of the film from lottery instant tickets. Styled in the form of a writing utensil, it is made of hare, tubular plastic and may have a rounded shape. The invention features a spring loaded push button at the top. This button controls the in and out movement of the scratcher member. The scratcher tip is angled to make scratching off the film easy.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved easy scratch pen tool comprising in combination:

an elongated housing member having a first end and a second end, the housing member having an interior hollow extending from the first end of the housing to the second of the housing, the housing member having an exterior surface, the first end of the housing member having a generally rectangular slot for providing an entry into the hollow;

a cap member being mounted to the second end of the housing member, the cap member having a cap hollow for positioning of a button rod with a coiled spring therein, the button rod having a button tip projecting outwardly from the cap member;

a clip being mounted between the cap and the housing member, the clip being formed of a resilient material and having a clip arm extending along a portion of the exterior surface of the housing member, the clip arm having a free end with a protrusion adjacent the exterior surface of the housing member; and an elongated scratcher member being generally rectangular and having a flat end and a scratcher tip, the scratcher member being sized for passing through the rectangular slot of the housing member for positioning within the interior hollow of the housing member, the flat end of the scratcher being in communication with and extending to the button rod of the cap, the scratcher tip is enclosed within the housing member and is capable of projecting outwardly therefrom when pressure is applied to the button tip.

2. An easy scratch pen tool comprising:

an elongated housing member having an interior hollow extending a length thereof, and having a slot for providing an entry into the hollow;

a cap member being mounted to the housing member, the cap member having a cap hollow for positioning of a button rod with a coiled spring therein, the button rod having a button tip projecting outwardly from the cap member; and an elongated scratcher member having a flat end and a scratcher tip, the flat end of the scratcher member being in communication with and extending to the button rod of the cap member.

3. The easy scratch pen tool as set forth in claim 2, wherein the housing member has a first end and a second end, and an exterior surface for receiving indicia.

4. The easy scratch pen tool as set forth in claim 2, further including a clip being mounted between the cap and the housing member, the clip being formed of a resilient material and having a clip arm extending along a portion of the exterior surface of the housing member, and the clip arm having a free end with a protrusion adjacent the exterior surface of the housing member.

5. The easy scratch pen tool as set forth in claim 2, wherein the scratcher member is sized for passing through the slot of the housing member for positioning within the interior hollow of the housing member.

6. The easy scratch pen tool as set forth in claim 5, wherein the scratcher tip is enclosed within the housing member and is capable of projecting outwardly therefrom when pressure is applied to the button tip of the button rod.

* * * * *